US011773709B1

(12) United States Patent
Gao et al.

(10) Patent No.: US 11,773,709 B1
(45) Date of Patent: Oct. 3, 2023

(54) DRILLING WELL UNDERGROUND KICK PROCESSING METHOD AND DEVICE WITH SELF-FEEDBACK ADJUSTMENT

(71) Applicant: China University of Petroleum (East China), Qingdao (CN)

(72) Inventors: Yonghai Gao, Qingdao (CN); Baojiang Sun, Qingdao (CN); Zhiyuan Wang, Qingdao (CN); Hao Li, Qingdao (CN); Yufa Su, Qingdao (CN); Bangtang Yin, Qingdao (CN); Xinxin Zhao, Qingdao (CN); Xuerui Wang, Qingdao (CN); Xiaohui Sun, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 17/825,711

(22) Filed: May 26, 2022

(30) Foreign Application Priority Data

Mar. 8, 2022 (CN) ..... 202210220433.2

(51) Int. Cl.
*E21B 44/00* (2006.01)
*E21B 49/00* (2006.01)
*E21B 47/06* (2012.01)

(52) U.S. Cl.
CPC ..... *E21B 44/00* (2013.01); *E21B 47/06* (2013.01); *E21B 49/003* (2013.01); *E21B 2200/20* (2020.05); *E21B 2200/22* (2020.05)

(58) Field of Classification Search
CPC ..... E21B 44/00; E21B 47/06; E21B 49/003; E21B 2200/20; E21B 2200/22; E21B 33/00
See application file for complete search history.

(56) References Cited

U.S. PATENT DOCUMENTS 8,838,426 B2 * 9/2014 Aldred ..... E21B 7/04 703/10
9,638,031 B2 * 5/2017 Li ..... E21B 49/00
2021/0180418 A1 * 6/2021 Sun ..... E21B 15/02

OTHER PUBLICATIONS

Zhan, Ronghui, and Jianwei Wan. "Neural network-aided adaptive unscented Kalman filter for nonlinear state estimation." (IEEE, 2006) IEEE Signal Processing Letters 13, No. 7: 445-448. (Year: 2006).*

(Continued)

*Primary Examiner* — Rehana Perveen
*Assistant Examiner* — Daniel E Miller
(74) *Attorney, Agent, or Firm* — Volpe Koenig

(57) ABSTRACT

A drilling well underground kick processing method and device are described. The method includes: collecting actual logging data $z_t$ at current moment; predicting, according to a filtering estimation value $\hat{x}_{t-1}$ of logging data at previous moment and the actual logging data $z_t$ at the current moment, a state prediction value $\hat{x}^-_t$ and a filtering estimation value $\hat{x}_t$ of the logging data at the current moment under the normal drilling condition by using a Kalman filter; inputting a prediction error, an innovation vector and a Kalman filtering gain matrix $K_t$ at the current moment into a pre-trained BP neural network; obtaining a corrected filtering estimation value $\hat{x}^1_t$ of the logging data at the current moment according to a filtering residual and the filtering estimation value $\hat{x}_t$ of the logging data at the current moment; and determining that a kick occurs under the condition that the corrected filtering estimation value $\hat{x}^1_t$ is not matched with the actual logging data $z_t$.

6 Claims, 4 Drawing Sheets

(56) References Cited

OTHER PUBLICATIONS

Vajargah, Ali Karimi, and Eric van Oort. "Early kick detection and well control decision-making for managed pressure drilling automation." (ScienceDirect, 2015) Journal of Natural Gas Science and Engineering 27: 354-366. (Year: 2015).*

Sun, Xiaohui, Baojiang Sun, Shuai Zhang, Zhiyuan Wang, Yonghai Gao, and Hao Li. "A new pattern recognition model for gas kick diagnosis in deepwater drilling." (ScienceDirect, 2018) Journal of Petroleum Science and Engineering 167: 418-425. (Year: 2018).*

Jiang, Hailong, Gonghui Liu, Jun Li, Tao Zhang, and Chao Wang. "A realtime drilling risks monitoring method integrating wellbore hydraulics model and streaming-data-driven model parameter inversion algorithm." (ScienceDirect, 2020) Journal of Natural Gas Science and Engineering 85: 103702. (Year: 2020).*

Pandey, Yogendra Narayan, Ayush Rastogi, Sribharath Kainkaryam, Srimoyee Bhattacharya, and Luigi Saputelli. "Machine learning in the oil and gas industry." (Apress, 2020) Berkeley, CA. pp. 26, 41, 106-107. ISBN-13 (pbk): 978-1-4842-6093-7 (Year: 2020).*

Wang, Chao, Gonghui Liu, Jun Li, Tao Zhang, Hailong Jiang, Honglin Huang, Zhongxi Zhu, Ming Luo, and Peng Huang. "Downhole mud loss transient simulation and detection with downhole dual measurement points." (ScienceDirect, 2021) Journal of Petroleum Science and Engineering 198: 108184. (Year: 2021).*

Haykin, Simon S., and Simon S. Haykin, eds. Kalman filtering and neural networks. vol. 284. New York: Wiley, 2001. (Year: 2001).*

Vaidehi, V., N. Chitra, M. Chokkalingam, and C. N. Krishnan. "Neural network aided Kalman filtering for multitarget tracking applications." Computers & Electrical Engineering 27, No. 2 (2001): 217-228. (Year: 2001).*

Nikoofard, Amirhossein, Tor Arne Johansen, and Glenn-Ole Kaasa. "Nonlinear moving horizon observer for estimation of states and parameters in under-balanced drilling operations." In Dynamic Systems and Control Conference, vol. 46209, p. V003T37A002. American Society of Mechanical Engineers, 2014. (Year: 2014).*

Mansure, A. J., G. L. Whitlow, G. P. Corser, J. Harmse, and R. D. Wallace. "A probabilistic reasoning tool for circulation monitoring based on flow measurements." In SPE Annual Technical Conference and Exhibition. OnePetro, 1999. (Year: 1999).*

Ojinnaka, Marcellinus Azuka. "Model-based estimation and real-time data analysis for well monitoring and early gas kick detection." PhD diss., The University of Texas At Austin, Dec. 2017 (Year: 2017).*

Pournazari, Parham. "Self-learning control of automated drilling operations". PhD diss., The University of Texas at Austin, May 2018. (Year: 2018).*

* cited by examiner

DRILLING WELL UNDERGROUND KICK PROCESSING METHOD AND DEVICE WITH SELF-FEEDBACK ADJUSTMENT

CROSS REFERENCE TO RELATED APPLICATIONS

This application claims priority to Chinese Application No. 202210220433.2, filed on Mar. 08, 2022, entitled "DRILLING WELL UNDERGROUND KICK PROCESSING METHOD AND DEVICE WITH SELF-FEEDBACK ADJUSTMENT", which is specifically and entirely incorporated by reference.

FIELD OF THE INVENTION

The present disclosure relates to the technical field of well drilling, in particular to a drilling well underground kick processing method and device with self-feedback adjustment.

BACKGROUND OF THE INVENTION

A traditional ground detection method cannot find complex conditions under a drilling well, and during gas invasion and kick detection, the ground detection method has the difficulty of observation on changes in the volume of a mud pit or the like and has detection delay.

SUMMARY OF THE INVENTION

An embodiment of the present disclosure aims to provide a drilling well underground kick processing method and device with self-feedback adjustment, which are used for detecting whether a kick occurs or not in real time.

In order to achieve the above purpose, an embodiment of the present disclosure provides a drilling well underground kick processing method, including: collecting actual logging data $z_t$ at current moment, wherein the logging data includes one or more of: a mechanical rotating speed, an outlet drilling fluid density, a mud pit volume, an outlet mud resistivity, a riser pressure, a drill bit weight, a drill bit depth, an inlet and outlet flow difference and an outlet flow; predicting, according to a filtering estimation value $\hat{x}_{t-1}$ of logging data at previous moment and the actual logging data $z_t$ at the current moment, a state prediction value $\hat{x}^-_t$ and a filtering estimation value $\hat{x}_t$ of the logging data at the current moment under the normal drilling condition by using a Kalman filter; obtaining a prediction error and an innovation vector at the current moment according to the state prediction value $\hat{x}^-_t$ and the filtering estimation value $\hat{x}_t$ of the logging data at the current moment and the actual logging data $z_t$ at the current moment; inputting the prediction error, the innovation vector and a Kalman filtering gain matrix Kt at the current moment into a pre-trained BP neural network, which outputs a filtering residual at the current moment;

obtaining a corrected filtering estimation value $\hat{x}^1_t$ of the logging data at the current moment according to the filtering residual and the filtering estimation value it of the logging data at the current moment; judging whether the corrected filtering estimation value $\hat{x}^1_t$ is matched with the actual logging data $z_t$ or not; and determining that a kick occurs under the condition that the corrected filtering estimation value $\hat{x}^1_t$ is not matched with the actual logging data $z_t$.

Correspondingly, an embodiment of the present disclosure further provides a drilling well underground kick processing device, including: a data collector, used for: collecting actual logging data $z_t$ at current moment, wherein the logging data includes one or more of: a mechanical rotating speed, an outlet drilling fluid density, a mud pit volume, an outlet mud resistivity, a riser pressure, a drill bit weight, a drill bit depth, an inlet and outlet flow difference and an outlet flow; an integrated processor, used for: predicting, according to a filtering estimation value $\hat{x}_{t-1}$ of logging data at previous moment and the actual logging data $z_t$ at the current moment, a state prediction value $\hat{x}^-_t$ and a filtering estimation value $\hat{x}_t$ of the logging data at the current moment under the normal drilling condition by using a Kalman filter, obtaining a prediction error and an innovation vector at the current moment according to the state prediction value $\hat{x}^-_t$ and the filtering estimation value $\hat{x}_t$ of the logging data at the current moment and the actual logging data $z_t$ the current moment, inputting the prediction error, the innovation vector and a Kalman filtering gain matrix Kt at the current moment into a pre-trained BP neural network which outputs a filtering residual at the current moment, and obtaining a corrected filtering estimation value $\hat{x}^1_t$ of the logging data at the current moment according to the filtering residual and the filtering estimation value $\hat{x}_t$ of the logging data at the current moment; and a central control unit, used for: judging whether the corrected filtering estimation value $\hat{x}^1_t$ is matched with the actual logging data $z_t$ or not, and determining that a kick occurs under the condition that the corrected filtering estimation value $\hat{x}^1_t$ is not matched with the actual logging data $z_t$.

According to the technical solution, the logging data is processed in real time by the combination of Kalman filtering and the BP neural network to obtain the estimation value of the logging data under the normal drilling condition. Whether the estimation value of the logging data is matched with the collected actual logging data or not is judged, and if the estimation value of the logging data is not matched with the collected actual logging data, it is determined that the kick occurs. According to the method, whether the kick occurs underground can be accurately judged in real time, so that the kick can be timely processed.

Other features and advantages of the embodiments of the present disclosure will be described in detail in the subsequent specific embodiments.

BRIEF DESCRIPTION OF DRAWINGS

The accompanying drawings are used to provide a further understanding of the embodiments of the present disclosure, constitute a part of the specification, and are used to explain the embodiments of the present disclosure together with the following specific embodiments, but do not constitute limitations to the embodiments of the present disclosure. In the drawings.

DETAILED DESCRIPTION OF THE EMBODIMENTS

The specific implementation modes of the embodiments of the present disclosure are described in detail below in combination with the accompanying drawings. It should be understood that the specific implementation modes described herein are only used for describing and explaining the embodiments of the present disclosure and are not used for limiting the embodiments of the present disclosure.

Figure 1:
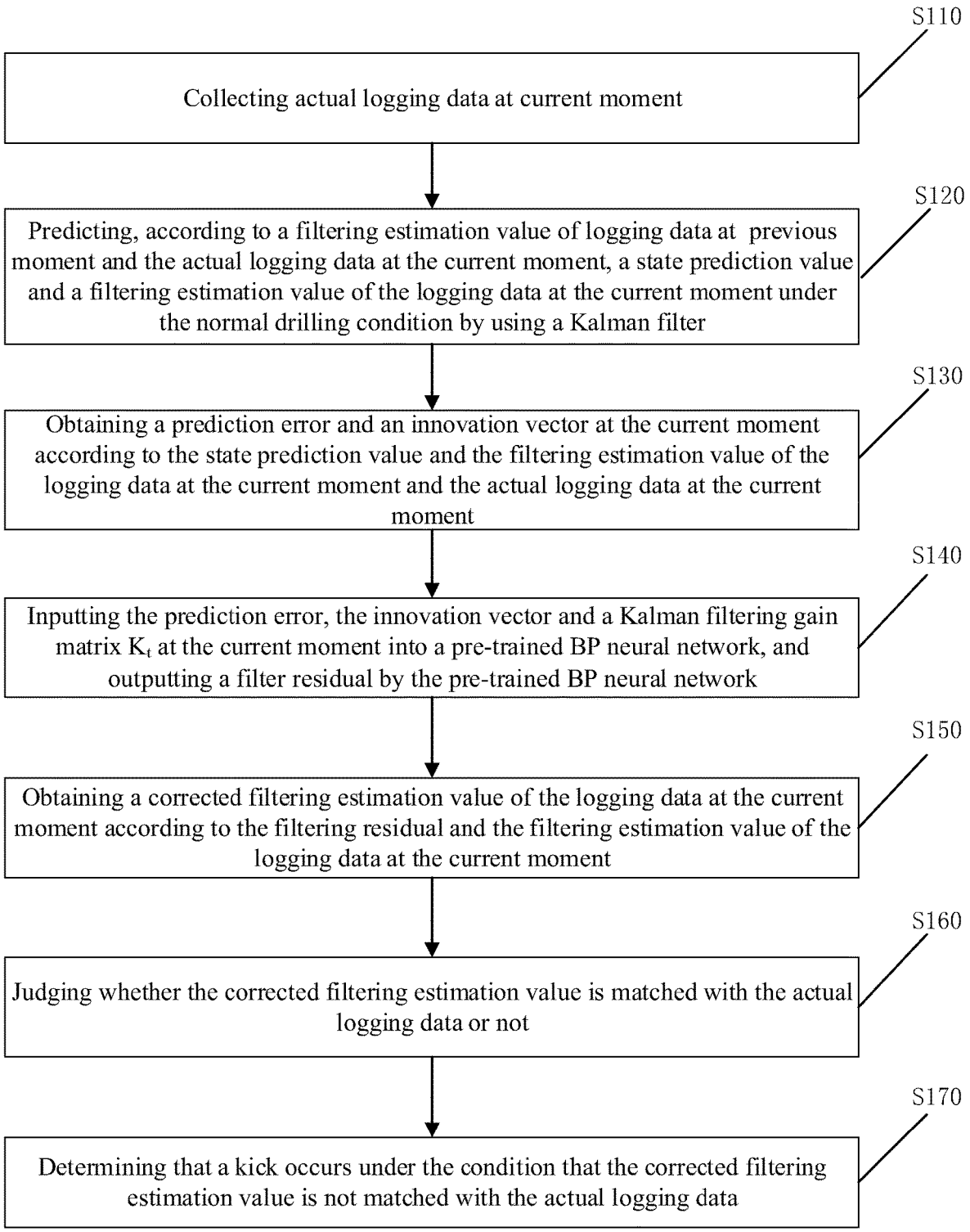
FIG. 1 shows a flow chart of a drilling well underground kick processing method according to an embodiment of the present disclosure.

FIG. 1 shows a flow chart of a drilling well underground kick processing method according to an embodiment of the present disclosure. As shown in FIG. 1, an embodiment of the present disclosure provides a drilling well underground kick processing method, including steps S110 to S170.

In the step S110, actual logging data $z_t$ at current moment is collected.

The logging data may include one or more of: a mechanical rotating speed, an outlet drilling fluid density, a mud pit volume, an outlet mud resistivity, a riser pressure, a drill bit weight, a drill bit depth, an inlet and outlet flow difference and an outlet flow. The logging data can be collected in real time through sensors while drilling, and the sensors while drilling include a temperature sensor, a pressure sensor, a liquid level sensor, a flow sensor, etc.

In the step S120, according to a filtering estimation value $\hat{x}_{t-1}$ of logging data at previous moment and the actual logging data $z_t$ at the current moment, a state prediction value $\hat{x}^-_t$ and a filtering estimation value $\hat{x}_t$ of the logging data at the current moment are predicted under the normal drilling condition by using a Kalman filter.

The Kalman filter used in the embodiment of the present disclosure is a standard Kalman filter. The basic principle of the standard Kalman filter is introduced below.

A state equation of the standard Kalman filter is:

$$\hat{x}^-_t = F\hat{x}_{t-1} + BU_{t-1} \tag{1}$$

In the formula, $\hat{x}^-_t$ is a state prediction value of logging data at a moment t, which is also called a priori state estimation value; $\hat{x}_{t-1}$ is a filtering estimation value at a moment t−1, which is also called a posterior state estimation value; F is a state transition matrix, the state transition matrix represents a theoretical model for describing changes of a target state, when a temperature change is calculated, F is a wellbore temperature field equation for describing the temperature change, and when a pressure change is calculated, F is a pressure field equation for describing the pressure change; and B is a control input matrix, and $U_{t-1}$ is the control input at the moment t−1.

An observation equation is:

$$z_t = H\hat{x}_t + v_t \tag{2}$$

$z_t$ is a measured value at the moment t; H is a state variable-to-measurement (observation) conversion matrix, and represents a relationship of connection of a state and observation; $v_t$ is observation noise at the moment t, the observation noise is related to a measurement error of a sensor, and the measurement error of the sensor can be simply considered as the observation noise. B, $U_{t-1}$, F and H in the formulas (1) and (2) are calculated according to a normal drilling flow model and are described hereafter.

The formula (2) may be represented by a formula (3) as follows:

$$z_t = \begin{bmatrix} 1 & & & \\ & 1 & & \\ & & \cdots & \\ & & & 1 \end{bmatrix} \begin{bmatrix} \hat{x}_{t1} \\ \hat{x}_{t2} \\ \cdots \\ \hat{x}_m \end{bmatrix} + \begin{bmatrix} v_{t1} \\ v_{t2} \\ \cdots \\ v_m \end{bmatrix} \tag{3}$$

The formula (3) indicates that a measured value of the sensor is regarded as an optimal estimation value plus a noise value, and n represents the number of parameters in the logging data and is a positive integer.

In the embodiment of the present disclosure, the "moment t" can be interchanged with the "current moment" for use, the "moment t−1" can be interchanged with the "previous moment" for use, and t is a positive integer not less than 1.

A prediction process and an updating process of the standard Kalman filter are as follows.

The prediction process:

priori estimation on a state value at the moment t:

$$\hat{x}^-_t = F\hat{x}_{t-1} \tag{4}$$

priori estimation on a covariance at the moment t:

$$P^-_t = FP_{t-1}F^T \tag{5}$$

In the formula, $P^-_t$ is a covariance between a true value and a prediction value at the moment t, which is also called a priori prediction state estimation covariance; $P_{t-1}$ is a covariance between a true value and a filtering estimation value at the moment t−1, which is also called a posterior estimation covariance.

The updating process:

a Kalman gain matrix at the moment t is:

$$K_t = \frac{P^-_t H^T}{HP^-_t H^T + R} \tag{6}$$

an optimal filtering estimation value at the moment t is calculated as follows:

a covariance matrix at the moment t is:

In the formula, I is an identity matrix, and $K_t$ is Kalman filtering gain; and R is a measurement noise covariance, which can be valued to be 0.01.

A normal drilling flow model is introduced below.

During normal drilling, fluid in a wellbore is drilling fluid and rock debris. When making a connection, the drilling fluid stops circulating, and a well bottom pressure is kept constant by applying a wellhead back pressure to make up the annulus frictional pressure drop during normal drilling.

A wellbore pressure balance relational expression is:

$$P_{BP} = P_P - P_s - P_a - P_{SF} \tag{9}$$

$$P_{BHP} = P_s + P_a + P_{SF} + P_{BP} \tag{10}$$

In the formula, $P_{BF}$ is a wellhead back pressure with the unit of MPa; $P_P$ is formation pore pressure with the unit of MPa, can be predicted through a formation pressure prediction method and is obtained by monitoring the formation in real time in the drilling process; $P_a$ is annulus circulatory pressure drop with the unit of MPa; $P_{SF}$ is a total downstream pressure drop of a throttle valve, with the unit of MPa; $P_{BHP}$ is a well bottom pressure with the unit of MPa; and $P_s$ is a riser pressure with the unit of MPa.

When no kick occurs in the drilling process, the whole system is in single-phase flow, and changes in pressure and flow over time can be obtained.

$$\frac{V_{Pie}}{\beta_{Pie}} \frac{dP_d}{dt} \times 10^3 = Q_{in} - Q_{bite} \tag{11}$$

$$\frac{V_{Anu}}{\beta_{Anu}} \frac{dP_{Choke}}{dt} \times 10^3 = Q_{bite} - Q_{out} \tag{12}$$

Through the conservation of momentum, the obtained is:

$$M\frac{dQ_{bite}}{dt} = P_d - P_{choke} - P_{fa} - P_{fp} - P_{bite} - P_{SF} = \Delta P_{CIR} \tag{13}$$

$$P_{BHP}=P_{Choke}+P_{fa}+P_{SF}+\rho_m gH\cos\theta \tag{14}$$

In the formula, $V_{pie}$ is a total volume in a drill string, with the unit of $m^3$, and is obtained by measurement in advance. $V_{Anu}$ is a total annulus volume with the unit of $m^3$, and is obtained by measurement in advance. $P_d$ is a pump pressure with the unit of MPa, and is obtained by measurement of a pump pressure sensor. $Q_{in}$ is a drilling fluid inlet flow with the unit of L/s, and is obtained by measurement of a flow sensor. $Q_{bite}$ is a flow at a drill bit, with the unit of L/s, and is obtained by measurement of a sensor. $Q_{out}$ is a drilling fluid outlet flow with the unit of L/s, and is obtained by measurement of an outlet flow sensor. $\beta_{Pie}$ is a compression coefficient of fluid in the drill string and can be obtained by measurement and calculation in advance. $\beta_{Anu}$ is an annulus fluid compression coefficient and can be obtained by measurement and calculation in advance. $P_{Choke}$ is a pressure drop of the throttle valve, with the unit of MPa, and can be obtained by measurement. $P_{fa}$ is an annulus circulatory pressure drop with the unit of MPa, and can be obtained by measurement of a PWD (Pressure While Drilling) sensor. $P_{fp}$ is a circulatory pressure drop in the drill string, with the unit of MPa, and can be calculated by a formula according to relevant parameters of the drilling fluid. $P_{bite}$ is a pressure drop of the drill bit, with the unit of MPa, and can be calculated by a formula according to relevant parameters of the drilling fluid. $\Delta P_{CIR}$ is a circulatory pressure loss with the unit of MPa, and can be calculated by a formula according to relevant parameters of the drilling fluid. M is a fluid mass with the unit of Kg. $\rho_m$ is a drilling fluid density with the unit of $kg/m^3$, and can be obtained by measurement in advance. H is a height of a liquid column, with the unit of m, and can be obtained by measurement in advance. $\theta$ is a well deviation angle and is obtained by measurement in advance.

Arrangement is performed to obtain:

$$P_d = 0.001(Q_{in} - Q_{bite}) \times \frac{\beta_{Pie}}{V_{Pie}}\Delta t \tag{15}$$

$$P_{Choke} = 0.001(Q_{bite} + Q_{BP} - Q_{out}) \times \frac{\beta_{Anu}}{V_{Anu}}\Delta t \tag{16}$$

$$Q_{bite} = (P_d - P_{Choke} - P_{fa} - P_{fp} - P_{bite} - P_{SF}) \times \frac{\Delta t}{M} \tag{17}$$

Assuming that the state equation is F, and the observation vector is z, a state vector is $x=[P_d\ P_{Choke}\ Q_{bite}\ P_{BHP}]^T$ and the observation vector is $z=[P_{BP}\ P_{BHP}]^T$.

Assuming that the sampling time of the Kalman filter is $\Delta t$, by means of an equation of conservation of mass and an equation of conservation of momentum, a single-phase flow state equation is obtained:

$$x_t=Fx_{t-1}+Bu_{t-1} \tag{18}$$

$$F = \begin{bmatrix} 1 & 0 & 0 & 0 \\ 0 & 1 & 0 & 0 \\ 0 & 0 & 1 & 0 \\ 0 & 0 & 0 & 1 \end{bmatrix} \tag{19}$$

-continued $$B = \begin{bmatrix} 0.001\times(Q_{in} - Q_{Bite}) & 0 & 0 & 0 \\ 0 & 0.001\times(Q_{Bite} + Q_{BP} - Q_{out}) & 0 & 0 \\ 0 & 0 & \Delta P_{CIR} & 0 \\ 0 & 0 & 0 & 1 \end{bmatrix} \tag{20}$$

$$U = \left[\frac{\beta_{pie}}{A_{pie}}\Delta t \frac{\beta_{Anu}}{A_{Anu}}\Delta t \frac{\Delta t}{M}\Delta t\ \mathrm{Cos}\theta\right]^T \tag{21}$$

An observation equation of a system is:

$$z_t=H\hat{x}^-_t+v_t \tag{22}$$

$$H = \begin{bmatrix} 0 & 1 & 0 & 0 \\ 0 & 0 & 0 & 1 \end{bmatrix} \tag{23}$$

In the formula, the value of H changes with different input control variables, but because the measured value is mostly directly measured by the sensor, the value of H usually takes on 1 or an state transition matrix, this is because the measured value of the sensor can be regarded as an optimal estimation value plus noise.

An output parameter is a difference between a true value and an estimation value, and an output value of the neural network and an estimation value which is not corrected by the neural network are added to obtain the estimation value which is very close to the true value.

The parameters of the standard Kalman filter can be determined by the formulas (19), (20), (21) and (23). An increment matrix $w_{t-1}$ at the moment t-1 is the product of B and U at the moment t−1. When the standard Kalman filter is used for estimation, the state prediction value $\hat{x}^-_t$ of the logging data at the current moment under the normal drilling condition is obtained by using the formula (4), and the filtering estimation value $\hat{x}_t$ of the logging data at the current moment under the normal drilling condition is obtained by using the formula (7).

In the step S130, a prediction error and an innovation vector at the current moment are obtained according to the state prediction value $\hat{x}^-_t$ and the filtering estimation value $\hat{x}_t$ of the logging data at the current moment and the actual logging data $z_t$ at the current moment.

The prediction error $\hat{x}_t$-$\hat{x}^-_t$ is obtained by calculating a difference between the state prediction value $\hat{x}^-_t$ and the filtering estimation value $\hat{x}_t$ of the logging data at the current moment; and the innovation vector $z_t$−$H\hat{x}_t$ is obtained by calculating a difference between the actual logging data $z_t$ and the prediction state $H\hat{x}^-_t$ at the current moment.

In the step S140, the prediction error, the innovation vector and a Kalman filtering gain matrix Kt at the current moment are input into a pre-trained BP neural network, and a filtering residual is output by the pre-trained BP neural network.

Figure 2:
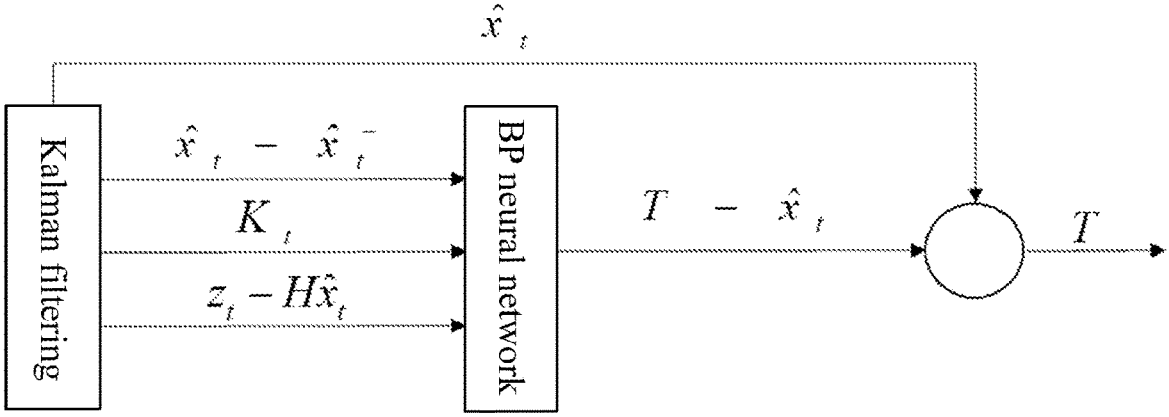
FIG. 2 shows a schematic diagram of a corrected filtering estimation value obtained according to Kalman filtering and a BP neural network.

The filtering residual is a difference between the true value and the filtering estimation value, and the output value of the neural network and the filtering estimation value are added to obtain the estimation value (namely, a corrected filtering estimation value) which is very close to the true value, as shown in FIG. 2.

The BP neural network may be pre-trained according to the following steps:

(1) obtaining a state prediction value, a filtering estimation value and a Kalman filtering gain of logging data at each of a plurality of historical moments;

(2) calculating a prediction error, an innovation vector and a filtering residual at the corresponding historical moment according to the actual logging data as well as the state prediction value and the filtering estimation value of the logging data at each historical moment;

(3) taking a part of data from historical data in advance to serve as a training set to complete training of a neural network prediction model, taking the prediction error, the innovation vector and the Kalman filtering gain as inputs, and determining nodes of a hidden layer according to an empirical formula $$h = \sqrt{m + n + \alpha},$$

wherein m is the number of nodes of an output layer, the neural network outputs a prediction value, the number of the nodes is 1, n is the number of nodes of an input layer, there are three inputs, the number of the nodes of the input layer is considered by integrating the dimensionalities of the three vectors, $\alpha$ is an empirical coefficient, and the value ranges from 1 to 10; and (4) in a measurement process, taking the prediction error, the innovation vector and the Kalman filtering gain at each measurement moment as the inputs of the BP neural network, taking the filtering residual at each moment as the output of the BP neural network, training the BP neural network, and continuously optimizing a weight until a weight updating threshold is met; and determining that the training of the BP neural network is completed under the condition that an error between the filtering residual calculated by using the BP neural network and an actual filtering residual meets a preset precision requirement.

The prediction error is a difference between the state prediction value and the filtering estimation value of the logging data, the innovation vector is a difference between the actual logging data and the prediction state, and the filtering residual is a difference between the filtering estimation value and the actual logging data. The filtering estimation value here preferably uses a corrected filtering estimation value.

Specifically, during first training, a weight vector Wk−1 of the BP neural network and a covariance matrix Pk−1 need to be initialized, and initialization values of the weight vector Wk−1 and the covariance matrix Pk−1 can be identity matrixes. Alternatively, the weight vector Wk−1 can be completed by random initialization, and an initial value is set between (−1,1). Wk−1 and Pk−1 in the former iteration can be used during non-first training. The process of training the BP neural network by using data at a moment k is as follows:

a state equation at the moment k is:

$$W_k = F_k W_{k-1} + W_{k-1} \tag{24}$$

an observation equation at the moment k is:

$$z_k + H\hat{x}_k + v_k \tag{25}$$

In the formula, $W_k$ is a weight vector of the BP neural network at the moment k, $W_{k-1}$ is a weight vector of the BP neural network at the moment k−1, and $F_k$ is a state transition matrix at the moment k. The moment k and the moment k−1 are two continuous moments in the historical data, and k is a positive integer not less than 1.

The Kalman filtering gain matrix at the moment k−1 is updated according to the following mode:

calculating $F_{k-1} = (H^T_{k-1} p_{k-1} H_{k-1} + R)^{-1}$; and calculating the Kalman filtering gain matrix $K_{k-1} = P_{k-1} H^T_{k-1} F_{k-1}$ at the moment k−1.

$F_{k-1}$ is a state transition matrix at the moment k−1, $H_{k-1}$ is a state variable-to-measurement conversion matrix at the moment k−1, R is a measurement noise covariance, and $P_{k-1}$ is a covariance matrix at the moment k−1.

The updated Kalman filtering gain matrix at the moment k−1 is used to update the weight and the covariance matrix of the BP neural network at the moment k.

The weight of the BP neural network at the moment k is updated: $W_k = W_{k-1} + k_{k-1} v_{k-1}$, wherein $v_{k-1}$ is an error between the output of the BP neural network and the actual output at the previous moment.

The covariance matrix at the moment k is updated: $P_k P_{k-1} - H_{k-1} H^T_{k-1} P_{k-1} + Q_{k-1}$.

$Q_{k-1}$ is observation noise at the moment k−1.

The Kalman filtering estimation value are corrected.

$$d_k = H_k W_k + \xi_{k-1} \tag{26}$$

$$\hat{x}^1_k = \hat{x}_k + v_{k-1} \tag{27}$$

In the formula, $\hat{x}^1_k$ is a corrected filtering estimation value at the moment k, $d_k$ represents a target output at the moment k, and can be approximately regarded as an actual output, and $\xi_{k-1}$ represents a difference (priori state estimation value) between an output (optimal estimation value) of a learning sample and actual output of the network at the moment k−1.

The above steps are repeated until the error between the filtering residual calculated by using the BP neural network and the actual filtering residual meets a preset precision requirement.

The trained BP neural network is used to obtain the filtering residual at the current moment.

In the step S150, a corrected filtering estimation value $\hat{x}^1_t$ of the logging data at the current moment is obtained according to the filtering residual and the filtering estimation value $\hat{x}_t$ of the logging data at the current moment.

The sum of the filtering estimation value $\hat{x}_t$ of the logging data and the filtering residual at the current moment is the corrected filtering estimation value $\hat{x}^1_t$ of the logging data at the current moment.

In the step S160, whether the corrected filtering estimation value $\hat{x}^1_t$ is matched with the actual logging data $z_t$ or not is judged.

Parameters of the Kalman filter are obtained by calculation of a normal drilling flow model, and therefore the corrected filtering estimation value $\hat{x}^1_t$ obtained by calculation of the Kalman filter and the BP neural network can be regarded as predicted logging data at the current moment under the normal drilling condition. The parameters of the Kalman filter include the state transition matrix, the state variable-to-measurement conversion matrix and the increment matrix. The normal drilling condition means that no kick occurs.

Therefore, whether a kick occurs or not can be determined by judging whether the corrected filtering estimation value $\hat{x}^1_t$ is matched with the actual logging data $z_t$ or not. Whether the difference between the corrected filtering estimation value $\hat{x}^1_t$ and the actual logging data $z_t$ exceeds a preset value or not can be judged to determine whether the corrected filtering estimation value is matched with the actual logging data or not, wherein the preset value can be set to be a proper value such as 0.01, or the preset value can be set to be 10 times or the like of the measuring range of the sensor.

In the step S170, it is determined that a kick occurs under the condition that the corrected filtering estimation value $\hat{x}^1_t$ is not matched with the actual logging data $z_t$.

If the difference between the corrected filtering estimation value $\hat{x}^1_t$ and the actual logging data $z_t$ does not exceed the preset value, it is considered that no kick occurs. If the difference exceeds the preset value, it is determined that a kick occurs.

In an extensible embodiment, whether the corrected filtering estimation value $\hat{x}^1_t$ is consistent with the change trend of the historical data obtained while drilling can be judged, if yes, it is determined that no kick occurs, and if not, it is determined that a kick occurs. Optionally, whether the change trend is consistent or not can be judged according to a slope. The kick in the embodiment of the present disclosure refers to a kick caused by gas invasion.

Figure 3:
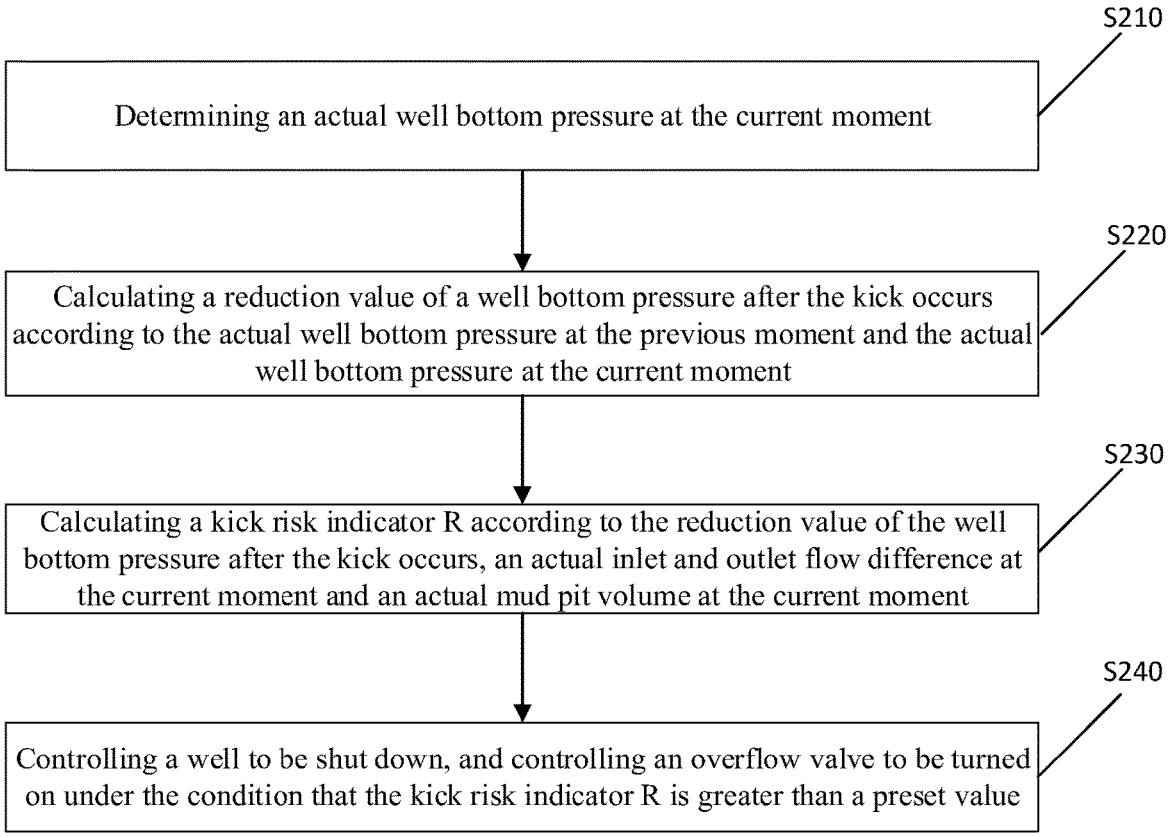
FIG. 3 shows a flow chart of determination of a kick risk indicator.

Further, under the condition that the kick occurs, a kick risk indicator can be calculated to perform further control. As shown in FIG. 3, the method specifically includes steps S210 to S240. The steps S210 to S240 can be executed by a central control unit of a drilling system, and the processing results of the real-time logging data, the Kalman filtering and the BP neural network are fed back to the central control unit in real time.

Step S210, an actual well bottom pressure at the current moment is determined.

The actual well bottom pressure at the current moment can be calculated according to the formula (9), wherein $P_{static}$, $P_a$, $P_{SF}$, $P_{BP}$ are values at the current moment.

Step 5220, a reduction value ΔP of the well bottom pressure is calculated after the kick occurs according to an actual well bottom pressure at the previous moment and the actual well bottom pressure at the current moment.

The actual well bottom pressure at the previous moment may be calculated and stored in advance at the previous moment. The reduction value ΔP of the well bottom pressure after the kick occurs is a difference between the actual well bottom pressure at the previous moment and the actual well bottom pressure at the current moment.

Step 5230, a kick risk indicator R is calculated according to the reduction value ΔP of the well bottom pressure after the kick occurs, an actual inlet and outlet flow difference ΔV at the current moment and an actual mud pit volume $V_{TVCA}$ at the current moment.

The kick risk indicator R is the product of the reduction value ΔP of the well bottom pressure after the kick occurs, the actual inlet and outlet flow difference ΔV at the current moment and the actual mud pit volume $V_{TVCA}$ at the current moment, namely $R=\Delta P\times\Delta V\times V_{TVCA}$.

Step S240, a well is controlled to be shut down, and an overflow valve is controlled to be turned on under the condition that the kick risk indicator R is greater than a preset value.

The preset value ranges from 1 to 10. For example, the preset value can be 1, and if R is greater than 1, the well can be controlled to be shut down, and the overflow valve can be controlled to be turned on. If R is not greater than 1, it can be determined that no kick occurs, and normal drilling continues to be performed.

In an extensible embodiment, the kick risk indicator R can be converted into a kick risk level, and different control measures are taken according to different risk levels. Table 1 is a kick risk level corresponding table.

TABLE 1 kick risk level corresponding table

| Gas invasion risk indicator R | Risk level |
|---|---|
| <1 | 1 |
| 1-10 | 2 |
| >10 | 3 |

When the risk level is level 2 or above, it is determined that a kick occurs, the well is controlled to be shut down, and the overflow valve is controlled to be turned on. Under the condition that the risk level is level 1, it is considered that a false alarm exists, no kick occurs, and normal drilling continues to be performed.

Further, according to the embodiment provided by the present disclosure, whether a kick occurs or not can be judged in combination with an XGBoost kick model. Kick logging data and normal drilling logging data in the historical data are input to an XGBoost classifier, the XGBoost classifier carries out learning, related parameters are adjusted, and therefore, a trained XGBoost kick model is obtained.

The corrected filtering estimation value $\hat{x}^1_t$ is input to a pre-trained XGBoost kick model, the XGBoost kick model performs preprocessing on the input data and outputs an indication of whether a kick occurs or not, and under the condition that the XGBoost kick model outputs the indication that the kick occurs and it is determined that the kick occurs through calculation of Kalman filtering and the BP neural network, it is determined that the kick occurs. The preprocessing includes: sorting the importance of features, screening redundant features, performing standardization, and the like.

If the indication output by the XGBoost kick model is inconsistent with the result determined by the calculation of the Kalman filtering and the BP neural network, the result determined by the calculation of the Kalman filtering and the BP neural network serves as the basis.

According to the mode provided by the embodiment of the present disclosure, whether the kick occurs in the well can be accurately judged in real time, and the kick can be processed in time.

Figure 4:
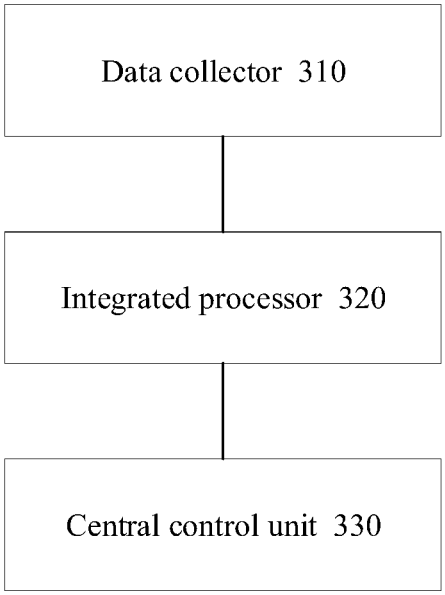
FIG. 4 shows a structural block diagram of a drilling well underground kick processing device according to an embodiment of the present disclosure.

FIG. 4 shows a structural block diagram of a drilling well underground kick processing device according to an embodiment of the present disclosure. As shown in FIG. 4, an embodiment of the present disclosure further provides a drilling well underground kick processing device, including: a data collector 310, used for: collecting actual logging data $z_t$ at the current moment, wherein the logging data includes one or more of: a mechanical rotating speed, an outlet drilling fluid density, a mud pit volume, an outlet mud resistivity, a riser pressure, a drill bit weight, a drill bit depth, an inlet and outlet flow difference and an outlet flow; an integrated processor 320, used for: predicting, according to a filtering estimation value $\hat{x}_{t-1}$ of logging data at the previous moment and the actual logging data $z_t$ at the current moment, a state prediction value $\hat{x}_t^-$ and a filtering estimation value $\hat{x}_t$ of the logging data at the current moment under the normal drilling condition by using a Kalman filter, obtaining a prediction error and an innovation vector at the current moment according to the state prediction value $\hat{x}_t^-$ and the filtering estimation value $\hat{x}_t$ of the logging data at the current moment and the actual logging data $z_t$ at the current moment, inputting the prediction error, the innovation vector and a Kalman filtering gain matrix Kt at the current moment into a pre-trained BP neural network which outputs a filtering residual at the current moment, and obtaining a corrected filtering estimation value $\hat{x}_t^1$ of the logging data at the current moment according to the filtering residual and the filtering estimation value $\hat{x}_t$ of the logging data at the current moment; and a central control unit 330, used for: judging whether the corrected filtering estimation value $\hat{x}_t^1$ is matched with the actual logging data $Z_t$ or not, and determining that a kick occurs under the condition that the corrected filtering estimation value $\hat{x}_t^1$ is not matched with the actual logging data $z_t$.

The central control unit 330 can also be used for determining an actual well bottom pressure at the current moment; according to the actual well bottom pressure at the previous moment and the actual well bottom pressure at the current moment, the reduction value of the well bottom pressure after kick is calculated; calculating a kick risk indicator R according to the reduction value of the well bottom pressure after the kick, the actual inlet and outlet flow difference at the current moment and the actual mud pit volume at the current moment; and under the condition that the kick risk indicator R is larger than a preset value, well shut-in is controlled, and an overflow valve is controlled to be opened.

The drilling well underground kick processing device can further include: a working condition identification processor, used for inputting the corrected filtering estimation value $\hat{x}_t^1$ into a pre-trained XGBoost kick model which outputs an indication of whether a kick occurs or not, and the central control unit also used for determining that a kick occurs under the condition that the XGBoost kick model outputs the indication that the kick occurs, wherein the XGBoost kick model is formed by learning kick logging data and normal drilling logging data in historical data.

The drilling well underground kick processing device further includes a signal transmitter, used for transmitting the corrected filtering estimation value $\hat{x}_t^1$ output by the integrated processor to a central control unit; and a miniature signal converter, used for converting data collected by the data collector into processable well field information and inputting the processable well field information to the integrated processor. In addition, signals output by the working condition identification processor can be reflected to the central control unit through the signal transmitter.

The data collector, the integrated processor, the signal transmitter, the working condition identification processor and the miniature signal converter are arranged underground and are packed through a packer. The central control unit can be a PC (Personal Computer) arranged above a well.

Figure 5:
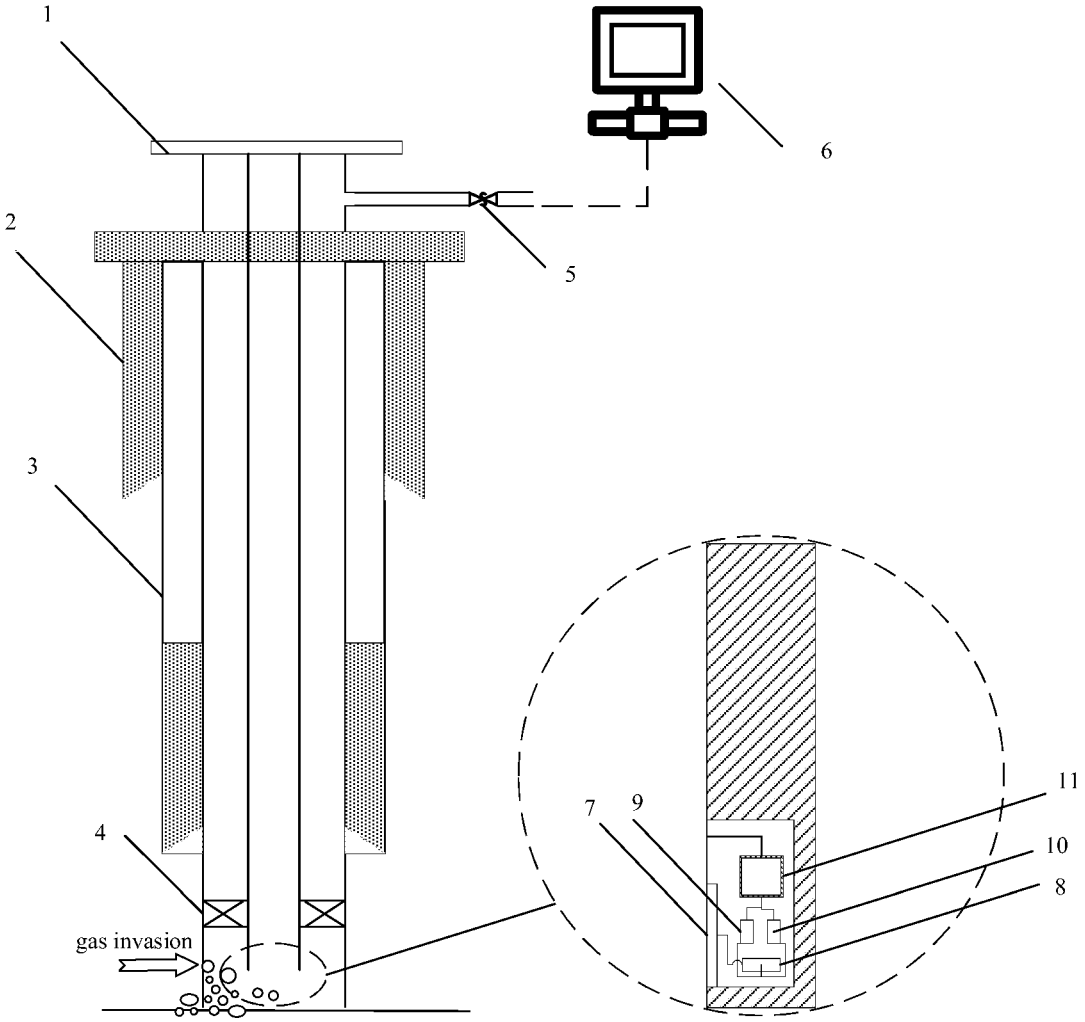
FIG. 5 shows a schematic diagram of installation of a drilling well underground kick processing device.

FIG. 5 shows a schematic diagram of installation of a drilling well underground kick processing device. As shown in FIG. 5, in an actual well drilling system, an intermediate casing 3 and a surface casing 2 are arranged on an outer side of a wall of a well. An overflow valve 5 is arranged above the well, and a pipeline where the overflow valve 5 is located is connected with a drill pipe between a wellhead 1 and the surface casing 2. A data collector 7, an integrated processor 9, a signal transmitter 11, a working condition identification processor 10 and a miniature signal converter 8 are arranged underground and are packed through a packer 4. A central control unit 6 receives the corrected filtering estimation value $\hat{x}_t^1$ through the signal transmitter, controls the well to be shut down when it is determined that a kick occurs, and controls the overflow valve 5 to be turned on to perform a well killing operation.

The data collector 7 may be a sensor while drilling and can receive underground while-drilling or ground comprehensive logging information. The miniature signal converter 8 is used for converting data collected by the data collector 7 into processable well field information, namely converting a format of the data collected by the data collector 7 into a format which can be processed by the integrated processor and the working condition identification processor, and respectively inputting the format to the integrated processor and the working condition identification processor.

The specific working principles and benefits of the drilling well underground kick processing device provided by the embodiments of the present disclosure are similar to the specific working principles and benefits of the drilling well underground kick processing method provided by the embodiments of the present disclosure, and will not be repeated here.

Those skilled in the art should understand that the embodiments of the present application may be provided as a method, system, or computer program product. Thus, the present application may take the form of an entire hardware embodiment, an entire software embodiment, or an embodiment combining software and hardware. Moreover, the present application may take the form of a computer program product implemented on one or more computer available storage media (including but not limited to a disk memory, CD-ROM, an optical memory, etc.) containing computer available program codes therein.

The present application is described with reference to flow charts and/or block diagrams of methods, devices (systems), and computer program products according to the embodiments of the present application. It should be understood that each flow and/or block in the flow charts and/or block diagrams and a combination of flows and/or blocks in the flow charts and/or block diagrams may be implemented by computer program instructions. The computer program instructions can be provided to a processor of a general-purpose computer, a dedicated computer, an embedded processor or other programmable data processing device to generate a machine, such that the instructions executed by the processor of the computer or the other programmable data processing device generate a device for implementing functions specified in one or more flows of the flow charts and/or one or more blocks of the block diagrams.

The computer program instructions may also be stored in a computer readable memory capable of booting the computer or other programmable data processing device to operate in a particular manner such that the instructions stored in the computer readable memory produce an article of manufacture including an instruction device, and the instruction device implements functions specified in one or more flows of the flow charts and/or one or more blocks of the block diagrams.

The computer program instructions may also be loaded onto the computer or other programmable data processing device such that a series of operation steps are executed on the computer or other programmable device to produce a computer-implemented process, such that the instructions executed on the computer or other programmable device provide steps for implementing functions specified in one or more flows of the flow charts and/or one or more blocks of the block diagrams.

In one typical configuration, a computing device includes one or more central processing units (CPUs), an input/output interface, a network interface, and a memory.

The memory may include a volatile memory, a random access memory (RAM) and/or a non-volatile memory, or the like in a computer readable medium, such as a read only memory (ROM) or a flash memory (flash RAM). The memory is an example of the computer readable medium.

The computer readable medium includes permanent and non-permanent, as well as mobile and non-mobile media which may implement information storage by any method or technique. The information may be computer readable instructions, data structures, modules of a program, or other data. Examples of a storage medium for a computer include but are not limited to phase change random access memories (PRAM), static random access memories (SRAM), dynamic random access memories (DRAM), other types of random access memories (RAM), read-only memories (ROM), electrically erasable programmable read-only memories (EEPROM), flash memories or other memory technologies, compact disc read-only memories (CD-ROM), digital video disks (DVD) or other optical memories, magnetic cartridge tapes, magnetic tape storage, magnetic disk storage or other magnetic storage devices, or any other non-transmission medium, which can be used to store information that can be accessed by the computing device. According to the definition herein, the computer readable medium does not include transitory computer readable media (transitory media), such as modulated data signals and carrier waves.

It also should be noted that the term "include", "comprise" or any other variants thereof is intended to encompass non-exclusive inclusion, such that a process, method, commodity or device including a series of elements includes not only those elements but also other elements that are not explicitly listed, or further include elements inherent to such a process, method, commodity or device. Without more restrictions, the element defined by the statement "including one . . . " does not exclude that additional identical elements are still present in the process, method, commodity or device that include the elements.

The above are only the embodiments of the present application, and are not used for limiting the present application. For those skilled in the art, various modifications and changes can be made to the present disclosure. Any modification, equivalent replacement, improvement and the like made within the spirit and principle of the present application should be included within the scope of the claims of the present application.

The invention claimed is:

1. A drilling well underground kick processing method, comprising:

collecting actual logging data $z_t$ at current moment, wherein the actual logging data comprises one or more of: a mechanical rotating speed, an outlet drilling fluid density, a mud pit volume, an outlet mud resistivity, a drill bit weight, and a drill bit depth;

predicting, according to a filtering estimation value $\hat{x}_{t-1}$ of logging data at previous moment and the actual logging data $z_t$ at the current moment, a state prediction value $\hat{x}_t^-$ and a filtering estimation value $\hat{x}_t$ of logging data at the current moment under a normal drilling condition by using a standard Kalman filter, wherein $\hat{x}_t^-=F\hat{x}_{t-1}+BU_{t-1}$, F is a state transition matrix, B is a control input matrix, and $U_{t-1}$ is a control input at the moment t−1;

obtaining a prediction error and an innovation vector at the current moment according to the state prediction value $\hat{x}_t^-$ and the filtering estimation value $\hat{x}_t$ of the logging data at the current moment and the actual logging data $z_t$ at the current moment, wherein the prediction error is $\hat{x}_t-\hat{x}_t^-$, and the innovation vector is $z_t-H\hat{x}_t$, $$H=\begin{bmatrix}0 & 1 & 0 & 0\\ 0 & 0 & 0 & 1\end{bmatrix};$$

inputting the prediction error, the innovation vector and a Kalman filtering gain matrix $K_t$ at the current moment into a pre-trained BP neural network, which outputs a filtering residual at the current moment;

obtaining a corrected filtering estimation value $\hat{x}_t^1$ of the logging data at the current moment according to the filtering residual and the filtering estimation value $\hat{x}_t$ of the logging data at the current moment;

judging whether the corrected filtering estimation value $\hat{x}_t^1$ is matched with the actual logging data $z_t$ or not; and determining that a kick occurs under a condition that the corrected filtering estimation value $\hat{x}_t^1$ is not matched with the actual logging data $z_t$;

wherein under a condition that the occurrence of the kick is determined, the method further comprises the following steps:

determining an actual well bottom pressure at the current moment;

calculating a reduction value of a well bottom pressure after the kick occurs according to an actual well bottom pressure at the previous moment and the actual well bottom pressure at the current moment;

calculating a kick risk indicator R according to the reduction value of the well bottom pressure after the kick occurs, an actual inlet and outlet flow difference at the current moment and an actual mud pit volume at the current moment; and controlling a well to be shut down, and controlling an overflow valve to be turned on under a condition that the kick risk indicator R is greater than a preset value.

2. The method according to claim 1, wherein the kick risk indicator R is a product of the reduction value ΔP of the well bottom pressure after the kick occurs, the actual inlet and outlet flow difference ΔV at the current moment and the actual mud pit volume $V_{TVCA}$ at the current moment; and the preset value ranges from 1 to 10.

3. The method according to claim 1, wherein the BP neural network is pre-trained according to the following steps:

obtaining a state prediction value, a filtering estimation value and a Kalman filtering gain of logging data at each of a plurality of historical moments;

calculating a prediction error, an innovation vector and a filtering residual at the corresponding historical moment according to actual logging data as well as the state prediction value and the filtering estimation value of the logging data at each historical moment;

training the BP neural network by taking the prediction error, the innovation vector and the Kalman filtering gain at each historical moment as inputs of the BP neural network, and taking the filtering residual at each historical moment as an output of the BP neural network; and determining that the training of the BP neural network is completed under a condition that an error between the filtering residual calculated by using the BP neural network and an actual filtering residual meets a preset precision requirement.

4. The method according to claim 1, wherein parameters of the Kalman filter are calculated by using a normal drilling flow model, and the parameters of the Kalman filter comprise a state transition matrix, a state variable-to-measurement conversion matrix and an increment matrix.

5. The method according to claim 1, further comprising:

inputting the corrected filtering estimation value $\hat{x}_t^1$ into a pre-trained XGBoost kick model, which outputs an indication of whether the kick occurs or not, and determining that the kick occurs under a condition that the XGBoost kick model outputs the indication that the kick occurs, wherein the XGBoost kick model is formed by learning kick logging data and normal drilling logging data in historical data.

6. The method according to claim 1, wherein the actual logging data further comprise one or more of a riser pressure, an inlet and outlet flow difference, and an outlet flow.

* * * * *